US007950463B2

(12) United States Patent
Fossli

(10) Patent No.: US 7,950,463 B2
(45) Date of Patent: May 31, 2011

(54) METHOD AND ARRANGEMENT FOR REMOVING SOILS, PARTICLES OR FLUIDS FROM THE SEABED OR FROM GREAT SEA DEPTHS

(75) Inventor: Borre Fossli, Oslo (NO)

(73) Assignee: Ocean Riser Systems AS, Oslo (NO)

( * ) Notice: Subject to any disclaimer, the term of this patent is extended or adjusted under 35 U.S.C. 154(b) by 0 days.

(21) Appl. No.: 12/419,446

(22) Filed: Apr. 7, 2009

(65) Prior Publication Data

US 2009/0200037 A1 Aug. 13, 2009

Related U.S. Application Data

(63) Continuation-in-part of application No. 10/549,059, filed as application No. PCT/NO2004/000069 on Mar. 12, 2004, now Pat. No. 7,513,310.

(30) Foreign Application Priority Data

Mar. 13, 2003 (NO) ..... 20031168

(51) Int. Cl.
*E21B 29/12* (2006.01)
*E02F 3/88* (2006.01)

(52) U.S. Cl. ..... 166/358; 175/5; 175/171; 175/207; 37/323

(58) Field of Classification Search ..... 166/358, 166/357, 368; 175/66, 70, 57, 206, 207, 175/22, 171; 37/322, 323, 344
See application file for complete search history.

(56) References Cited

U.S. PATENT DOCUMENTS

| | | | |
|---|---|---|---|
| 2,929,610 | A | 3/1960 | Stratton |
| 3,252,528 | A | 5/1966 | Nicolson |
| 3,322,191 | A | 5/1967 | Bullard |
| 3,426,844 | A | 2/1969 | McDaniel |
| 3,519,071 | A | 7/1970 | Word, Jr. |

(Continued)

FOREIGN PATENT DOCUMENTS

DE 1634475 8/1970

(Continued)

OTHER PUBLICATIONS

PCT Search Report dated Oct. 8, 2004 of Patent Application No. PCT/NO2004/000069 filed Mar. 12, 2004.

(Continued)

*Primary Examiner* — Thomas A Beach
(74) *Attorney, Agent, or Firm* — Vern Maine & Associates

(57) ABSTRACT

A method for removing soils, particles or fluids from the seabed or from great sea depths, includes positioning a platform or a vessel above an offshore location, lowering a riser from the vessel or platform to the seabed or great depth, the riser being vented to the atmosphere, sucking soils, particles or fluids with inflow of fluid into the riser and removing them from the riser via an outlet in the riser, the outlet being at a level well below the water surface, by use of a pumping system with a flow return conduit running to a selected location, while keeping the level of the fluid in the riser at a level between the outlet and the surface corresponding with a pressure in the lower end of the riser substantially lower than the sea water pressure at the end of the riser.

20 Claims, 2 Drawing Sheets

U.S. PATENT DOCUMENTS 3,522,670 A * 8/1970 Todd et al. ..... 37/314
3,603,409 A 9/1971 Watkins
3,621,910 A 11/1971 Sanford et al.
3,732,143 A 5/1973 Joosse
3,782,460 A 1/1974 Skinner
3,815,673 A 6/1974 Bruce et al.
3,833,076 A 9/1974 Griffin, III
3,963,077 A 6/1976 Faulkner
4,046,191 A 9/1977 Neath
4,055,224 A 10/1977 Wallers
4,063,602 A 12/1977 Howell et al.
4,091,881 A 5/1978 Maus
4,099,583 A 7/1978 Maus
4,210,208 A 7/1980 Shanks
4,220,207 A 9/1980 Allen
4,224,988 A 9/1980 Gibson et al.
4,291,722 A 9/1981 Churchman
4,291,772 A 9/1981 Beynet
4,376,467 A * 3/1983 Allen ..... 175/7
4,479,741 A * 10/1984 Berti et al. ..... 405/163
4,511,287 A 4/1985 Horton
4,646,844 A 3/1987 Roche et al.
4,719,937 A 1/1988 Roche et al.
4,759,413 A 7/1988 Bailey et al.
4,813,495 A 3/1989 Leach
5,184,686 A 2/1993 Gonzalez
5,277,640 A 1/1994 Shinmyou et al.
5,727,640 A 3/1998 Gleditsch
5,848,656 A 12/1998 Moksvold
6,102,673 A 8/2000 Mott et al.
6,263,981 B1 7/2001 Gonzalez
6,276,455 B1 8/2001 Gonzalez
6,328,107 B1 12/2001 Maus
6,401,823 B1 6/2002 Gonzalez et al.
6,412,574 B1 * 7/2002 Wardley et al. ..... 175/7
6,415,877 B1 7/2002 Fincher et al.
6,454,022 B1 9/2002 Sangesland et al.
6,457,529 B2 10/2002 Calder et al.
6,474,422 B2 11/2002 Schubert et al.
6,530,437 B2 * 3/2003 Maurer et al. ..... 175/5
6,536,540 B2 3/2003 deBoer
6,578,637 B1 6/2003 Maus et al.
6,648,081 B2 11/2003 Fincher et al.
6,745,857 B2 6/2004 Gjedebo
6,802,379 B2 10/2004 Dawson et al.
6,843,331 B2 1/2005 deBoer
6,854,532 B2 2/2005 Fincher et al.
6,926,101 B2 8/2005 deBoer
6,953,097 B2 10/2005 Seyffert
6,966,367 B2 11/2005 Butler et al.
6,966,392 B2 11/2005 deBoer
6,981,561 B2 1/2006 Krueger et al.
7,027,968 B2 4/2006 Choe et al.
7,044,237 B2 5/2006 Leuchtenberg
7,055,623 B2 6/2006 Calderoni et al.
7,066,247 B2 6/2006 Butler et al.
7,090,036 B2 8/2006 deBoer
7,093,662 B2 8/2006 deBoer
7,174,975 B2 2/2007 Krueger et al.
7,270,185 B2 * 9/2007 Fontana et al. ..... 166/358
7,526,884 B2 * 5/2009 Taplin ..... 37/321
7,676,966 B2 * 3/2010 Taplin ..... 37/321
2002/0081158 A1 * 6/2002 Strong et al. ..... 405/232
2004/0238177 A1 12/2004 Fossli
2008/0296062 A1 * 12/2008 Horton et al. ..... 175/5

FOREIGN PATENT DOCUMENTS

FR 2787827 6/2000
NO 305138 B1 4/1999
NO 306174 B1 9/1999
NO 312915 B1 2/2001
WO 99/18327 A1 4/1999
WO 0039431 7/2000
WO 03/023181 A1 3/2003

OTHER PUBLICATIONS

Norwegian Search Report dated Aug. 18, 2003 of International Application No. 20031168 filed Mar. 12, 2004.

Norwegian Search Report dated Feb. 15, 2005 of International Application No. PCT/NO02/00317 filed Sep. 10, 2002.

* cited by examiner

METHOD AND ARRANGEMENT FOR REMOVING SOILS, PARTICLES OR FLUIDS FROM THE SEABED OR FROM GREAT SEA DEPTHS

RELATED APPLICATIONS

This application is a continuation-in-part of U.S. application Ser. No. 10/549,059, filed Sep. 13, 2005, which is a US National Phase of PCT Application No. PCT/NO2004/000069, filed Mar. 12, 2004, which claims priority to Norwegian Application No. NO 2003 1168, filed Mar. 13, 2003, all of which are herein incorporated by reference in their entirety for all purposes.

FIELD OF INVENTION

The present invention relates to a particular arrangement for use when removing soils, particles or fluids from the seabed or from great sea depths using offshore structures that float or are connected to the seabed by other means. More particularly, it describes a vented riser with an outlet to a pump system so arranged so that the liquid level in the riser can be controlled between the surface and the depth of the outlet to make the hydrostatic pressure inside the bottom of the riser equal to or below that of seawater at that depth.

BACKGROUND OF THE INVENTION

Experience from subsea drilling operations in upper soil layers has shown that the subsurface formations to be drilled usually have very low fracture strength (301) close to the seabed and it is often close to that of seawater (302). This dictates that drilled formation will have to be disposed on seabed since the formation strength is not high enough to support the hydrostatic pressure from the combined effect of drilling mud and the suspended drilled formation solids in a drilling riser up to the drilling platform (304). This is the reason for that it is not possible to install a conventional drilling riser and take the returns to the surface, before a casing is set so deep that it will isolate the weaker formation and that the soil strength is high enough to support a liquid column of water and formation cuttings (debris) up to the drilling unit above sea level.

The 2 uppermost sections of the hole are normally drilled riserless, without a drilling riser. Often this "pump and dump" procedure cause for excessive amount of drilling mud, barite weighting materials, formation solids and other chemicals to be dumped to the ocean. Besides this practice being expensive it is also a wasteful process that can be harmful to marine life on the ocean floor.

In deeper waters as the hole deepens, the difference between the formation pore pressure and the formation fracture pressure remains low. The fracture gradient is so low that it can not support the hydrostatic pressure from a full column of seawater and formation cuttings up to the drilling platform. In addition to the static hydraulic pressure acting on the formation from a standing column of fluid in the well bore there are also the dynamic pressures created when circulating fluid through the drill bit. These dynamic pressures acting on the bottom of the hole are created when drill fluid is pumped through the drill bit and up the annulus between the drill string and formation. The magnitude of these forces depends on several factors such as the rheology of the fluid, the velocity of the fluid being pumped up the annulus, drilling speed and the characteristics of the well bore/hole. Particularly for smaller diameter hole sizes these additional dynamic forces can become significant. Presently these forces are controlled by drilling relatively large holes thereby keeping the annular velocity of the drilling fluid low and by adjusting the rheology of the drilling fluid. The formula for calculating these dynamic pressures is stated in the following detailed description. This new pressure seen by the formation in the bottom of the hole caused by the drilling process is often referred to as Equivalent Circulating Density (ECD).

Since this ECD effect can be neutralized by the system as described in patent application PCT/NO02/00317 the surface hole can be drilled deeper than with conventional drilling methods. This is an advantage since the next section can also be drilled deeper hence it is possible to the drill the well with fewer casings if the surface casing can be set deeper. Hence considerable economic effects can be expected from drilling the surface hole deeper.

SUMMARY OF THE INVENTION

As was described in the parent application Ser. No. 10/549,059, incorporated herein by reference in its entirety for all purposes, the invention included a particular novel arrangement, which can be used for drilling a subsurface hole without having to discharge subsurface formations to the surrounding seabed when drilling the hole prior to installing the surface conductor (structural) steel pipe and prior to installing the surface casing, at which point the riser and subsea BOP is installed in conventional drilling. By performing drilling operations with this novel arrangement as claimed, all formation and soil will be circulated and pumped up to the surface vessel or platform. The arrangement comprises the use of elements of prior known art but is arranged so that new drilling methods can be achieved. By arranging the various systems coupled to the drilling riser in this particular way, a totally new and never before used method can be performed.

The new method presented there also allows for the riser to be run before setting any casings. The reason for this possibility is that the hydrostatic pressure at the bottom of the riser can be regulated to the same or less than that of seawater from sea level, regardless of the fluid density inside the drilling riser. This is achieved by having an outlet on the riser below the surface of the water that is connected to a pump system that will be able to regulate the liquid level inside the drilling riser to a depth below sea level. In this particular way will it be possible to pump drilling fluid (mud) through the drill string and up the annulus between the riser and the drill string together with formation cuttings without fracturing or loosing returns caused by the weak topsoil formations.

In all present drilling operations to date in offshore drilling with a semi submersible rig or drillship, this top hole drilling is performed riserless. The debris and drill cuttings are until now handled in 2 different ways. 1) The returns are discharged and flow freely into seawater as the drilling fluid and formation debris are pumped up the hole. The drilling fluid and formation will then be spread out on the seabed around the borehole. 2) After the well is spudded and the first structural/conductor casing is set, some equipment is run on the drill string that will connect to a suction hose and a pump placed on seabed. The majority of the drill fluid and cuttings is then sucked from the top of the hole and pumped away from the drill site to a different location on seabed. This cutting transport system will not remove the cutting from the seabed but just re-locate them.

Lately concepts has been presented that will pump the return from seabed up to the drilling platform thorough a separate hose with the help of a pumping system on seabed after the structural or conductor casing has been set. This is indicated in patent NO312915. Here the pump is place on the seabed and no drilling riser is installed.

In one aspect the present invention in a particular combination gives rise to new, practically feasible and safe methods of drilling the surface hole deeper with the riser installed from floating structures. In this aspect, benefits over the prior art are achieved. More precisely the invention gives instructions on how to drill and control the hydraulic pressure exerted on the formation by the drilling fluid at the bottom of the hole being drilled by varying the liquid level in the drilling riser. With this novel invention, both kick and handling of hydrocarbon gas can be safely and effectively controlled. It is possible to add a surface BOP on top of the drilling riser (410)

Since the pressure in the end of the riser can be defined by the density of the liquid and the vertical height of the liquid column, the surface structural conductor can be run on the end of the riser and be drilled/undereamed or jetted in place with returns being circulated to the surface with the help of the Low Riser Return System (LRRS). No cuttings or formation is being deposited on the seabed or to the ocean.

Once the structural conductor is jetted in place the riser is disconnected at LRMP (233), the telescope joint (221) removed and the riser lengthened. The riser is reconnected and the second surface hole for the surface casing can be drilled with drilling mud. All returns and mud will be circulated to surface with the LRRS. Since the bottom hole pressure can be designed to stay below the fracture pressure of the formation being drilled, the surface hole can be drilled deeper.

After the structural casing is in place a surface BOP can be installed on top of the riser. The BOP will be used in case of shallow pockets of hydrocarbons are encountered and hydrocarbons are circulated into the riser when drilling the hole for the surface casing.

There may be at least one choke line in the upper part of the drilling riser of equal or greater pressure rating than the drilling riser. By incorporating the above features a well functioning system will be achieved that can safely perform drilling operations of the top 2 hole sections. By having a surface blowout preventer on top of the drilling riser, all hydrocarbons can safely be bled off through the drilling rig's choke line manifold system.

In one aspect the present invention overcomes many disadvantages of other attempts and meets the present needs by providing methods and arrangements whereby the fluid-level in the riser can be dropped below sea level and adjusted so that the hydraulic pressure in the bottom of the hole can be controlled by measuring and adjusting the liquid level in the riser in accordance with the dynamic drilling process requirements. Due to the dynamic nature of the drilling process the liquid level will not remain steady at a determined level but will constantly be varied and adjusted by the pumping control system. A pressure control system controls the speed of the subsea mud lift pump and actively manipulates the level in the riser so that the pressure in the bottom of the well is controlled as required by the drilling process. With the methods described it is possible to regulate the pressure in the bottom of the well without changing the density of the drilling fluid.

The ability to control pressures in the bottom of the hole and at the same time and with the same equipment being able to contain and safely control the hydrocarbon pressure on surface makes the present invention and riser system completely new and unique.

The method of varying the fluid height can also be used to increase the bottom-hole pressure instead of increasing the mud density. This means that the surface hole can be drilled at an angle/deviated while controlling the bottom hole pressure. This is not easily achieved with a conventional riser or achieved drilling riserless due to problems with hole stabilities when drilling with un-weighted seawater in a deviated borehole hole.

Normally as drilling takes place deeper in the formations the pore pressure will also vary. In conventional drilling operation the drilling mud density has to be adjusted. This is time-consuming and expensive since additives have to be added and is discharged out to the sea without being able to reclaim the mud and chemicals. With the LRRS system the mud will be reclaimed at surface hence a more purpose fit drilling mud can be used which will drill a more gauged hole and better samples and cores can be collected.

In another aspect of the invention there is provided a method and system for retrieving soil, particles or fluids from the seabed or deep waters. The invention in this aspect utilizes the same principle as for controlling downhole pressure as described above, whereby a riser is lowered to the desired depth, the riser having an outlet to a pump system, which pump system is used to lower the level of the interface in the riser between the liquid in the riser and a gas above the liquid to a level somewhere between the outlet and the surface, and hence lower the pressure at the lower end of the riser as compared to sea water pressure at that depth. This methodology permits liquid to be sucked into the lower end of the riser and further into the pump. From the pump the liquid may be pumped to the surface or elsewhere.

Particles or soil near the lower end of the riser will also be sucked into the riser along with the liquid. This makes this arrangement and method ideal for sea mining, e.g. for retrieving manganese nodules from the seabed. It may also be used for retrieving samples of marine life or sea water from great depths, or recovery of debris or materials deposited on the seabed during other operations, whether intentional or otherwise. Other and various subsea research, mining, and recovery operations are within the scope of the invention.

In order facilitate removal of soils or particles from the seabed, a tubing can be lowered through the riser, or alternatively together with the riser, or be otherwise configured with an outlet or nozzle positioned to discharge at or near the lower end of the riser. Through the tubing liquid or gas can be pumped at sufficient pressure to create a jet below the lower end of the riser. The jet may be used to loosen the soils or material deposits and suspend particles from the soils or material deposit in the water, so that they may more easily be sucked into the riser together with the water.

Other and various aspects of the invention within the scope of the appended claims will be readily apparent from this teaching.

DETAILED DESCRIPTION OF THE INVENTION

Figure 1:
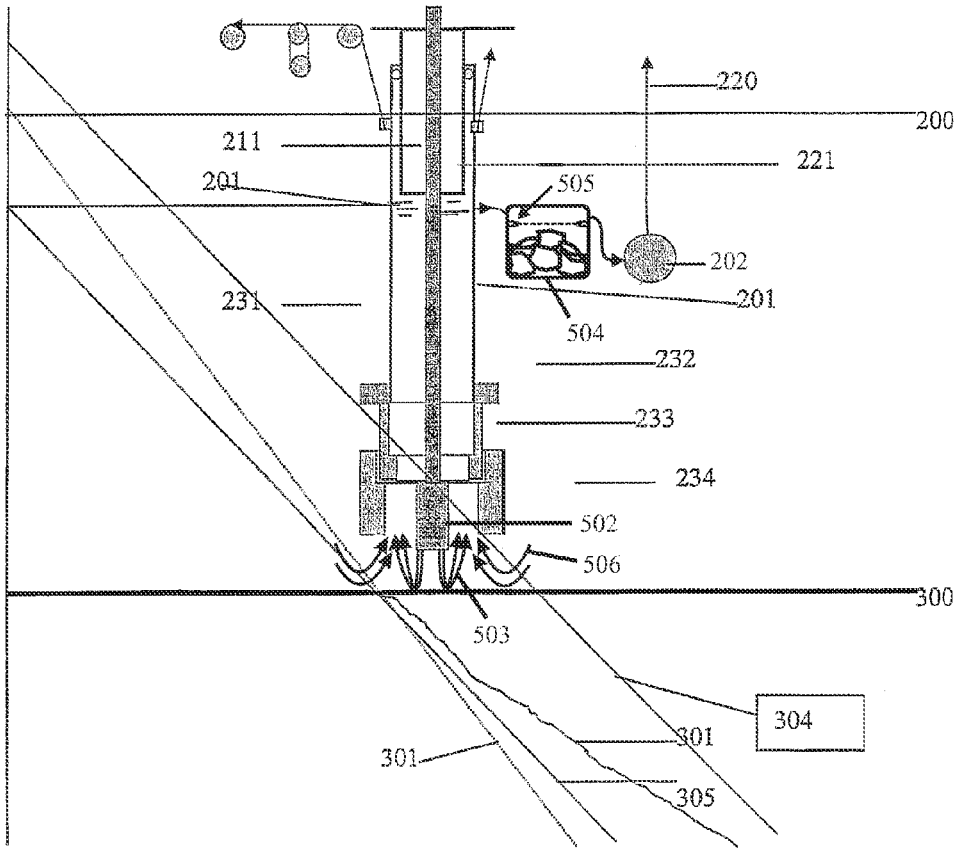
FIG. 1 is a schematic diagram of one embodiment of the invention for controlling pressure at the lower end of a riser at less than seawater pressure through control of fluid level in the riser, the figure incorporating a depth versus pressure graph as an overlay.

As was described in the parent application, the riser tube 201 has a lower outlet between the sea level and ocean floor with valves 204 that will divert the fluid in the riser tube into the submersible pump system which will pump the fluid and solids back up to the surface.

By being able to drop the air/liquid level in the riser to a level below sea level, it is also possible to create a pressure inside the riser which is below that of seawater, which can be seen from gradient 305 which is below that of 302 which is seawater pressure gradient from sea level 200. This implies that seawater will flow into the end of the riser tube up into the lower outlet of the riser tube into the subsea pump 202 which will pump the content through the return conduit 220 back to a surface vessel.

When starting the drilling operation from a floating vessel the first structural conductor 236 can be run on the end of the riser tube 201. The conductor housing 234 is connected to the surface structural conductor and the riser connected to the conductor housing 234 with a pin connector 233. The structural conductor is lowered into the seabed prior to running the drill string 211. When the drill string 211 is run inside the riser 201 down to the seafloor 300, when pumping through the drillstring up the inside of the riser the pressure inside the riser at seabed is regulated to just below that of seawater at that depth (line 305) by lowering or adjusting the air/liquid level inside the riser tube 210.

Figure 2:
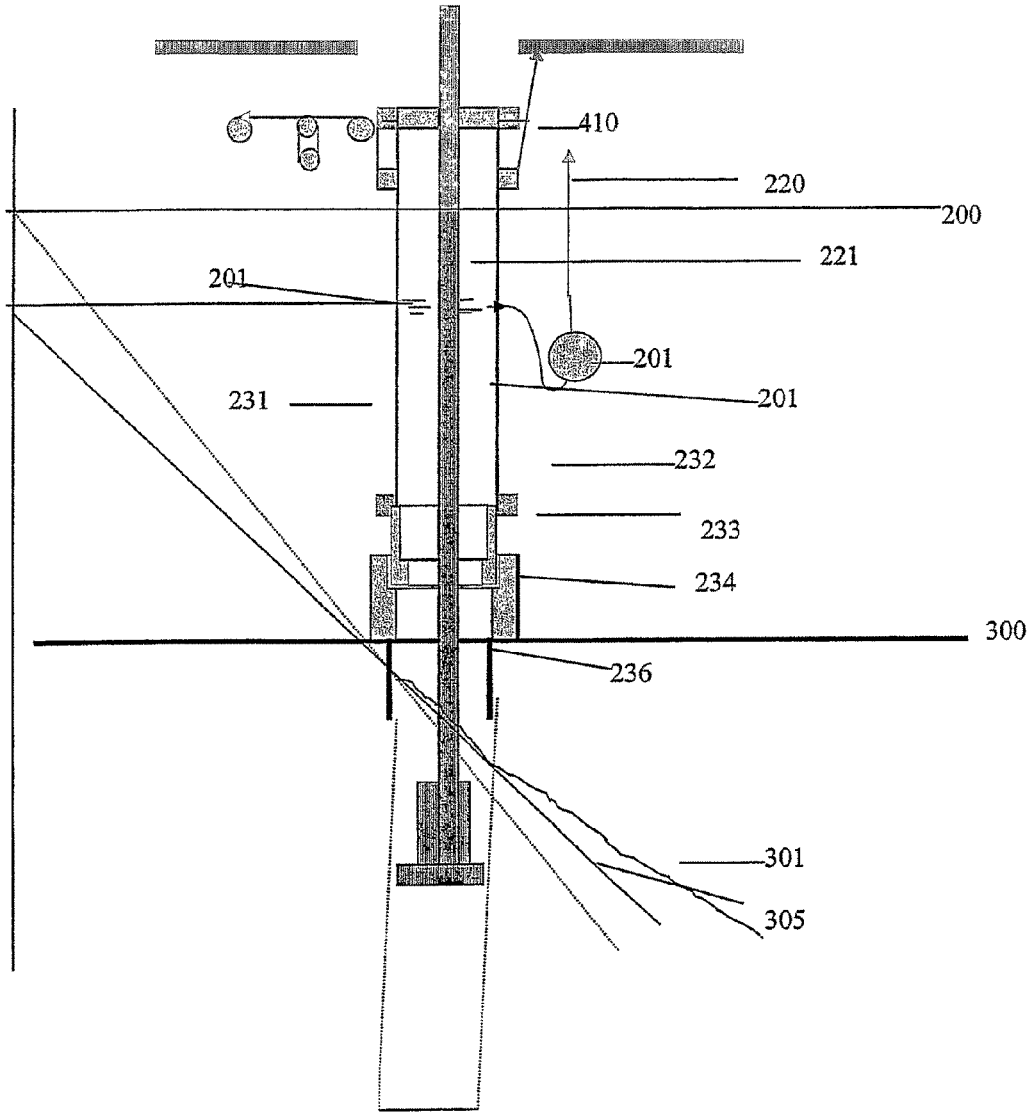
FIG. 2 is a schematic diagram of the FIG. 1 embodiment of the invention, the riser having been functionally extended by the use of a structural conductor into a well bore.

The formation soils being removed by the drill bit is pumped up to surface by the pump system 202 to the surface. As the hole deepens the riser and structural conductor is lowered by help of the riser tensioning system 501 until the structural conductor housing is at an appropriate height above seabed 234 in FIG. 2. In the process of removing soils from the borehole the pressure 305 in the hole due to this operation can be controlled by regulating the level of the liquid/air inside the riser to lie between that of the pressure due to seawater 302 and the soil fracture gradient 301. As can be seen by FIG. 1, bringing the returns from the well all the way back to the surface as in conventional drilling would not be possible. Since the hydrostatic pressure from the drilling fluid 304 would fracture the week formation soils 301 and the level would not reach back to surface before the returns would be lost to the shallow subsurface soils.

The application of this methodology extends to removal or retrieval of seabed soils and particles on the ocean floor as in seabed mining. Seawater (506) will flow into the riser tube and transport any solids in suspension back up to the surface via the pump system. The system used for this may be of the same type as described above and shown in FIGS. 1 and 2. However, there will be no need for a BOP or a structural conductor. The end of the riser may be suspended from the platform or vessel at the surface and lowered to the desired depth. The outlet to the submersible pump system may be at any point below the surface. However, the lower the outlet is situated, the lower the level of the interface of the riser fluid with the air at the top of the riser may be set by pumping out water via the pump system. Hence the lower the pressure that may be achieved at the lower end of the riser, below seawater pressure at that depth. A lower pressure at the lower end of the riser will result in a greater suction and greater ability to suck up larger and/or heavier particles or denser soil.

In order to prevent the pump from becoming damaged by the particles, a particle collection tank, or so-called gumbo box may be included in the line extending from the outlet from the riser to the pump. This tank may be configured to collect particles that are larger than the pump can handle. When the tank is full or when it is decided to stop the pumping, the tank may be hoisted to the surface and emptied. The advantage of collecting only the larger particles in such a collection tank is that the smaller particles and the water are pumped to the surface, and the tank only needs to accommodate the particles that cannot be pumped.

The system may also be used for pumping fish or other marine life or living organisms from great depths. The fish may also be collected in a subsea collection tank for later or periodic retrieval or, if the fish is small enough and the pump is of a type that will not damage the fish, be pumped all the way to the surface. Suitable sensors may be employed to detect the quantity and character of the contents of the collection tank.

Depending on the material that is being retrieved from the sea, a pump will be chosen, that may handle this material. For larger particles and live organisms above a certain size, e.g., a peristaltic pump or other positive displacement pump may be used.

The invention is susceptible of other embodiments. For example, there is a method for removing soils, particles or fluids from the seabed or from great sea depths, comprising positioning a platform or a vessel above an offshore location; extending a riser from the vessel or platform so as to position the lower end of the riser at a selected subsea depth, which may be the seabed itself or a depth in a bore in the seabed. The riser may be vented to the atmosphere. The riser is configured with an outlet at a level below the water surface, which is connected to a pump system having a return line running to a selected location which may be but is not limited to a surface platform or vessel, a subsea collection system, another location on or beneath seabed. When the riser, pump system and selected location are in place and operational, the method proceeds with sucking particles suspended in fluid, typically sea water but there may be a localized subsea fluid pocket, with an inflow of the fluid into the riser to the level of the outlet, removing the particles and fluid from the riser through the outlet and the return line to the selected location while keeping the level of the fluid level in the riser at a level between the outlet and the sea surface corresponding with a selected suction pressure in the lower end of the riser that is substantially lower than the sea water pressure at the lower end of the riser, by use of the pump system and appropriate fluid level sensors in the riser. Particles in this context can be soil particles, debris, marine life or any material of a particulate size and density susceptible of being loosened and suspended in and carried by a fluid flow through a conduit in this manner.

The method may include generating a fluid jet stream (503) to whirl up the particles at the lower end of the riser, where the whirled up particles are sucked by fluid flow into the lower end of the riser. The pump system may be a type capable of pumping particles suspended in water such that particles and fluid are readily pumped through the return line to the selected location. The selected location may be a processing station where particles of interest are recovered for further processing. There may be a collection tank or gumbo box (504) placed between the outlet and the pump system, where the method includes collecting particles above a selected size in the collection box, including particles too big to be passed through the pump system. The collection box (504) may monitored with sensors (505) and/or be emptied from time to time or otherwise operated to remove or recover particles of interest. The pump system (201) may be positioned anywhere between the seabed and the water surface, including being externally supported on the riser. The riser is vented to atmosphere, so the pressure in the riser above the fluid level is at or below atmospheric pressure. The riser outlet is situated substantially below the water surface, providing a fluid level control range that assures the availability of a substantially lower than sea water pressure at the lower end of the riser.

The method may include creating a jet stream (503) at the lower end of the riser for loosening particles for suction into the riser by pumping a fluid through a tubing configured with a nozzle (502) proximate the lower end of the riser. The tubing may but is not required to extend from the surface through the riser to the lower end. The source of the jet stream (503) may be localized to the lower end of the riser, as by use of a jet pump and sea water. At least the lower end of the riser may be moved laterally and/or vertically as needed to continue the process.

Other and various examples and embodiments within the scope of the claims, and equivalents thereto, will be readily apparent from this teaching.

The invention claimed is:

1. A method for removing submerged items from the seabed or from great sea depths, the method comprising:

positioning a platform or a vessel above an offshore location;

extending a riser from the vessel or platform so as to position the lower end of the riser at a selected subsea depth, said riser being vented to the atmosphere, said lower end being open to seawater surrounding said lower end, said riser being configured with an outlet at a level below the water surface, said outlet connected to a pump system having a return line running to a selected location;

sucking said submerged items suspended in a fluid with an inflow of said fluid into the open lower end of said riser to the outlet, said fluid being mainly sea water drawn from a region external to but proximal to said open lower end of said riser; and removing said particles and fluid from the riser via the outlet and return line to the selected location while keeping the level of the fluid in the riser at a level between the outlet and the sea surface corresponding with a selected pressure in the lower end of the riser substantially lower than the sea water pressure at the lower end of the riser by use of the pump system.

2. The method of claim 1, wherein a jet stream is created proximal to the lower end of the riser, said jet stream tending to agitate submerged items into suspension in said fluid so as to be sucked into the lower end of the riser.

3. The method of claim 1, wherein a collection tank is placed between the outlet and the pump system, said method further comprising collecting submerged items above a selected size in the collection tank.

4. The method of claim 1, wherein the pump system is of a type capable of pumping submerged items suspended in water from the outlet through the pump system to the selected location.

5. The method of claim 4, wherein the pump system comprises a peristaltic pump.

6. The method of claim 1, wherein the pump system is situated between the seabed and the water surface.

7. The method of claim 1, wherein the outlet from the riser is situated substantially below the water surface.

8. The method of claim 2, wherein said jet stream is created by pumping a jet stream fluid through a tube configured with a nozzle proximate the lower end of the riser.

9. The method of claim 1, wherein the selected location to which the return line extends is said platform or vessel.

10. The method of claim 1, wherein the selected location to which the return line extends is a separate tender support vessel at the surface.

11. The method of claim 8, wherein said tube is extended through the riser.

12. The method of claim 1, wherein the pressure in the riser above said fluid level is at or below atmospheric pressure.

13. The method of claim 3, said selected size of said submerged items being a size that cannot be handled by the pump system.

14. The method of claim 3, further comprising monitoring the contents of said collection tank with at least one sensor, and servicing the collection tank as needed.

15. The method of claim 1, further comprising repositioning the lower end of the riser laterally or vertically as needed to continue the removing of submerged items.

16. The method of claim 1, said selected subsea depth being the seabed.

17. A method for removing submerged items from the seabed or from great sea depths, the method comprising:

sucking said submerged items suspended in a fluid at a selected subsea depth with an inflow of said fluid into the open lower end of a riser suspended from the surface to an outlet in the riser, said lower end being open to seawater surrounding said lower end, said fluid being mainly sea water drawn from a region external to but proximal to said open lower end of said riser; and removing said particles and fluid from the riser via the outlet and through a return line to a selected location while keeping the level of the fluid in the riser between the outlet and the sea surface at a level corresponding with a selected pressure in the lower end of the riser substantially lower than the sea water pressure at the lower end of the riser by use of a pump system disposed between the outlet and the return line.

18. The method of claim 17, said selected location being the sea surface, said return line extending from the pump system to the sea surface.

19. The method of claim 17, further comprising:

collecting larger submerged items than may be passed through the pump system in a collection tank disposed between the outlet and the pump system.

20. The method of claim 17, further comprising:

creating a jet stream proximal to the lower end of the riser, said jet stream tending to agitate submerged items into suspension in said fluid for suction into the riser, said jet stream being created by pumping a jet stream fluid through a tube configured with a nozzle proximate the lower end of the riser.

* * * * *